United States Patent [19]

Arnoldy

[11] Patent Number: 4,493,963

[45] Date of Patent: Jan. 15, 1985

[54] MANDREL MACHINE

[76] Inventor: Roman Arnoldy, P.O. Box 40472, Houston, Tex. 77240

[21] Appl. No.: 416,403

[22] Filed: Sep. 9, 1982

[51] Int. Cl.[3] ..... B23K 9/04

[52] U.S. Cl. ..... 219/76.1; 219/160; 219/61

[58] Field of Search ..... 219/159, 160, 61, 60 A, 219/60 R, 76.1, 76.14

[56] References Cited

U.S. PATENT DOCUMENTS

| | | | |
|---|---|---|---|
| 1,642,825 | 9/1927 | Pearce | 219/160 |
| 2,803,559 | 8/1957 | Rutherfurd et al. | 219/76.1 X |
| 3,592,997 | 7/1971 | Durie | 219/61 X |
| 4,229,642 | 10/1980 | Sakurai et al. | 219/60 A |

*Primary Examiner*—Roy N. Envall, Jr.
*Assistant Examiner*—C. M. Sigda
*Attorney, Agent, or Firm*—Fulbright & Jaworski

[57] ABSTRACT

A method and machine for weld cladding, particularly for welding material to a cylindrical plate, such as hard-facing or corrosion resistant alloys normally applied as claddings. The machine has a mandrel extending from it for supporting and rotating the plate. The mandrel is supported by beams and driven either by hand or by a motor. Rotating the mandrel rotates the plate supported on the mandrel through the path of a welding apparatus. Flanges can be provided to hold the plate on the mandrel. Bearings can be provided in the beams to facilitate the rotation of the mandrel.

7 Claims, 3 Drawing Figures

FIG. 1
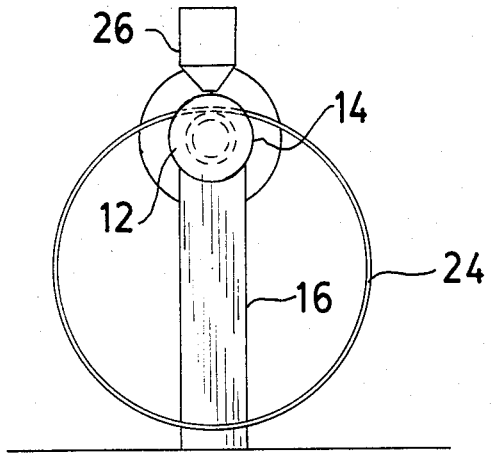
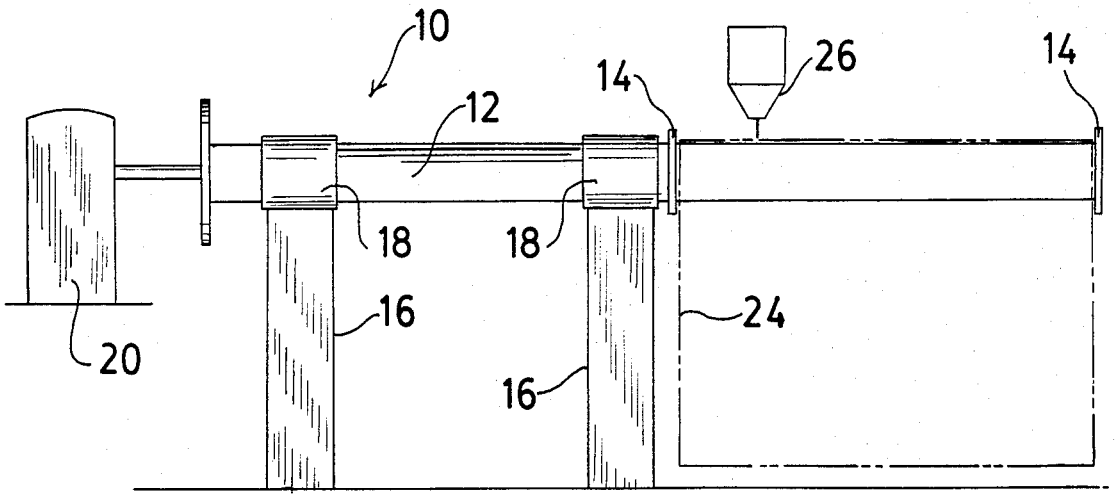
FIG. 2

MANDREL MACHINE

BACKGROUND OF THE INVENTION

1. Field of the Invention

The present invention relates to welding and particularly to welding hardfacing material, corrosion resistant alloys and other weld claddings to a plate.

2. Description of Prior Art

There are a number of prior art welding apparatuses and methods for applying corrosion resistant alloys, claddings and "hardfacings" to plates. "Hardfacing" is the method of providing an abrasion resistant object that has a desired pattern of random cracks extending through it. Several methods of hardfacing incorporate various welding techniques for welding the hardfacing materials to objects. The conventional methods and apparatuses for producing welded hardfaced objects or plates include both flat-plate methods such as described in my U.S. Pat. Nos. 3,494,749; 3,079,888 and 3,060,307, and cylindrical plate methods such as described in my U.S. Pat. No. 4,237,362. In the flat-plate method a plate is held and strapped down to prevent its distortion while a welding apparatus deposits hardfacing material on the plate. In the cylindrical-plate method the plate is secured to a cylindrical supporting surface which is mounted on a drum or spindle which is placed on rollers and then rotated beneath a weld nozzle.

In the cylindrical plate method the necessity of mounting the cylindrical support on a drum or spindle is inefficient and uneconomical. Elimination of the need for the drum or spindle and of the support rollers would significantly simplify the cylindrical-plate method of hardfacing. Also, use of a drum or spindle results in distortion of the plate about the drum or spindle either because of distortion of the drum itself during the operation or the unequal shrinking of the plate about the legs of the spindle.

SUMMARY OF THE INVENTION

The present invention is directed to a method and apparatus for accomplishing precise and efficient weld cladding or hardfacing. According to the present invention a machine is provided which has a mandrel which is used to support and rotate a plate. Any plate with an opening that can receive the mandrel can be welded on the apparatus, or a flat plate can be employed which rolls over the mandrel as the mandrel turns it, but the preferred shape is cylindrical. The mandrel protrudes into or through the cylindrical plate. The mandrel is mounted on beams so that the cylindrical plate is supported above the floor where it can rotate. Drive means connected to the mandrel rotate the mandrel which in turn, due to its frictional contact with the plate, rotates the plate. Appropriate conventional bearings can be provided in the beam supports to facilite the mandrel's rotation. The drive means can be manual or power means such as a conventional electric or hydraulic motor. Flanges can be provided on the mandrel to hold the plate in the desired position on the mandrel. If desired, multiple mandrels can be employed for holding or for driving, spaced about the surface of the plate.

The mandrel is situated in proximity to a welding apparatus so that the welding apparatus can deposit cladding or hardfacing material on the plate as the mandrel rotates the plate past the welding apparatus. In this way a desired precise distance can be maintained between the plate and the welding apparatus. Also, by using conventional control means for the drive means, precise speeds of rotation can be maintained thereby insuring that the desired uniform and consistent cladding or hardfacing effect is achieved without unwanted variation.

This "mandrel method" of cladding or hardfacing eliminates the need for mounting cylindrical or oval plates on a drum or spindle. It also eliminates the need for support rollers beneath the plate or for guide rollers on the sides of the plate. According to the present invention, the plate can simply be placed on the mandrel by hand or by lifting means such as a conventional crane. The mandrel itself supports the plate thereby eliminating the support rollers, the guide rollers, and the drum or spindle. Also eliminated is the step of connecting the drum or spindle to a drive means since the mandrel can be maintained connected to a drive means.

It is, therefore, an object of this invention to provide a creatively simplified method and apparatus for welding.

It is a particular object of the present invention to provide a new and efficient method and apparatus for welding hardfacing material to a flat, oval or cylindrical plate.

Another object of the present invention is the elimination of the need for mounting a cylindrical or oval plate to be welded on a drum or spindle.

A further object of the present invention is the elimination of guide and support rollers required by prior art methods and apparatuses.

Yet another object of the present invention is the provision of a machine having at least one extending mandrel for supporting and rotating the object to be welded.

An additional object of the present invention is the provision of such a machine in which a flange is provided on the mandrel for maintaining the position of the object of the mandrel.

Another object of the present invention is the provision of a method employing such machines.

Yet another object of the present invention is the provision of a welding method for a plate in which the plate to be welded can be set on a mandrel either by hand or by conventional means such as a crane.

A particular object of the method according to the present invention is the elimination of the necessity of connecting a mounting spindle or drum to a drive means for each welding operation by providing a drive means which can remain connected to a support mandrel.

Other and further objects, features and advantages will be apparent from this specification, the claims, and the following description of the presently preferred embodiments of the invention, given for the purpose of disclosure, when taken in conjunction with the accompanying drawings.

BRIEF DESCRIPTION OF THE DRAWINGS

FIG. 1 is a side elevational view illustrating a ccylindrical plate on a mandrel of a machine according to the present invention.

FIG. 2 is a front view of a machine according to the present invention.

DESCRIPTION OF PREFERRED EMBODIMENT

Figure 3:
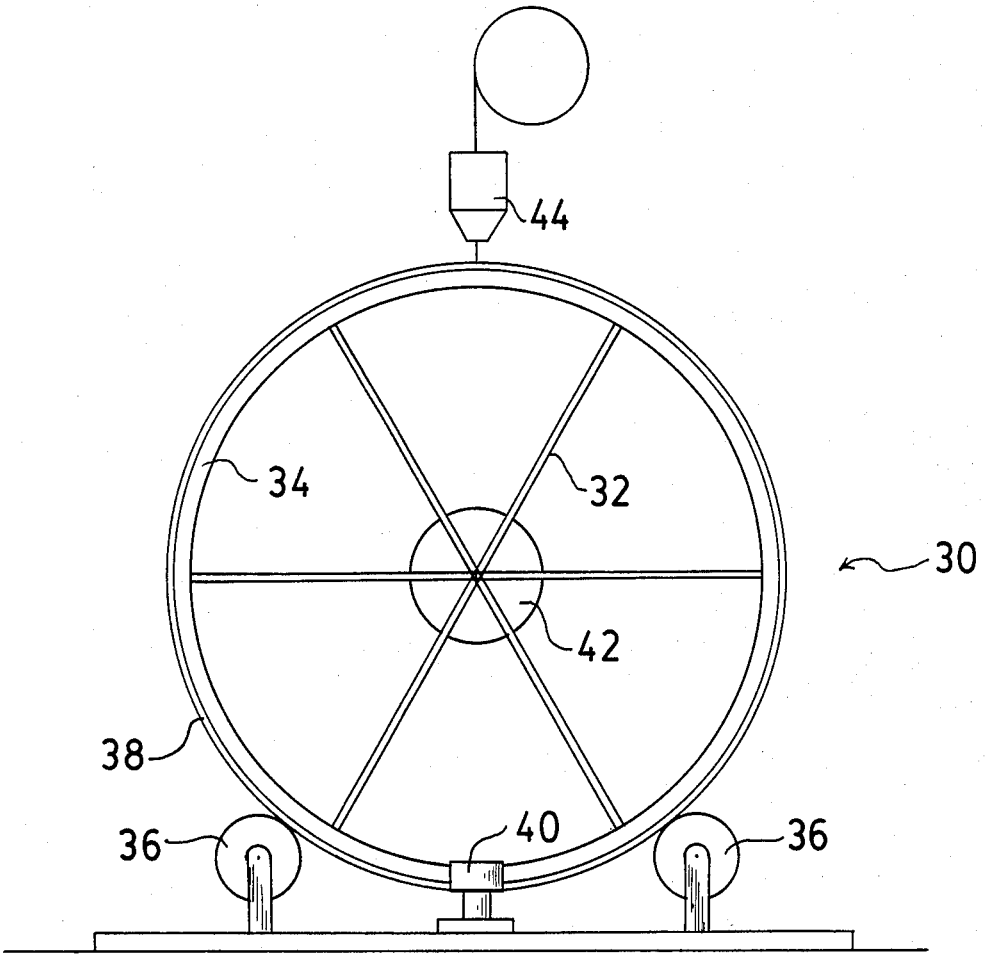
FIG. 3 is a side elevational view of a prior art cylindrical plate machine showing a drum and spindle support.

By way of illustration and not limitation, this detailed description presents the presently preferred embodiment of the present invention. Referring now to FIGS. 1 and 2, a plate 24 to be clad or hardfaced has a cylindrical shape. The machine 10 has beam means such as the beams 16 which support the machine 10. The mandrel shaft 12 is supported by the beams 16 and is rotatably mounted through bearing means such as the conventional bearings 18 in the top of the beams 16.

As shown in FIGS. 1 and 2 the mandrel 12 extends through and beyond the beams 16, projecting so that it can accommodate and support the cylindrical plate 24. Flange means such as the flanges 14 can be provided on the mandrel 12 to prevent the cylindrical plate 24 from moving on the mandrel and to hold it in position during the welding process. The flanges 14 can be movable and securable on the mandrel 12 so that they can be adjusted for the particular plate being welded. As desired, drive means such as the conventional electric motor 20 can be drivingly connected to the mandrel shaft 12. Although this preferred embodiment is directed to a plate such as an oval or cylindrical plate having an opening for receiving the mandrel, this invention can be used with flat plates by providing some conventional support means to support the plate as it moves over a single mandrel or by providing dual mandrels or a plurality of mandrels for support and rotation.

A conventional welding apparatus such as the welding nozzle 26 is located in proximity to the mandrel 12 in a desired position for performing the welding operation, either above the mandrel 12 as shown in FIG. 2 or to the side or bottom as expedient.

FIG. 3 illustrates a prior art device for cylindrical plate welding. The apparatus 30 requires a spindle 32 attached to a drum 34. The spindle 32-drum 34 combination is connected to the plate 38 which is to be welded. The spindle-drum-plate combination must be moved into place on the support rollers 36. The plate is guided by the guide rollers 40 during rotation. The spindle 32 must be connected to the rotative means 42 prior to the welding operation so that the plate 38 is rotated beneath the welding apparatus 44.

The surface of the mandrel 12 can be roughened or treated as desired to obtain the proper frictional contact between the mandrel 11 and the plate 38, or a sleeve such as a copper sleeve can be placed on the mandrel both for frictional purposes and for heat dissipation.

The present invention eliminates the need for the spindle, thereby eliminating the step of connecting the spindle to a rotative means. It maintains a precise distance between the weld nozzle and the surface of the plate to be cladded or hardfaced. Also, the present invention eliminates the need for the support rollers and guide rollers.

The foregoing disclosure and description of the invention is illustrative and explanatory and various changes in the details of the described machine and method may be made within the scope of the following claims without departing from the spirit of the invention.

What is claimed is:

1. A machine supporting and rotating a cylindrical or oval metal plate having an opening therethrough which is to have welded to it cladding material, corrosion-resistant material or hardfacing material, welding means being disposed above the machine for welding the material to the plate, the machine comprising a rotatable substantially cylindrical mandrel for inserting into and supporting the plate, the longitudinal axis of the mandrel disposed horizontally, the mandrel being receivable within the opening in the plate, the horizontal axis of the mandrel spaced from the horizontal axis of the plate so that the two axes are offset and non-coincident, the mandrel protruding into the opening in the plate and the outer diameter of the mandrel being less than the inner diameter of the plate so that the mandrel contacts less than the entire inner surface of the plate's opening, the mandrel contactingly supporting the plate so that no other apparatus is needed to brace or support the plate, and the mandrel holding the plate beneath the welding means so that upon rotation of the mandrel the plate is rotated by the mandrel, the plate being rotated about its horizontal axis past the welding means for welding the material to the plate, the mandrel supporting the plate to uniformly maintain the distance between the welding means and the part of the plate being welded, and beam means connected to the mandrel for supporting the mandrel.

2. The machine of claim 1 wherein bearing means are connected to the beam means so that the mandrel rotates in the bearing means.

3. The machine of claim 1 wherein flange means are provided on the mandrel for limiting the plate's lateral movement on the mandrel while it is rotating.

4. The machine of claim 1 wherein drive means are connected to the mandrel for rotating the mandrel.

5. A machine supporting and rotating a cylindrical or oval metal plate having an opening therethrough which is to have welded to it cladding material, corrosion-resistant material or hardfacing material, welding means being disposed above the machine for welding the material to the plate, the machine comprising a rotatable substantially cylindrical mandrel for receiving and supporting the plate, the longitudinal axis of the mandrel positioned horizontally, the mandrel being receivable within the opening in the plate and having an outer diameter less than the inner diameter of the plate so that when the plate is placed on the mandrel the horizontal axis of the mandrel is spaced from the horizontal axis of the plate resulting in the two axes being offset and non-coincident, the mandrel protruding into the opening in the plate and contacting less than the entire inner surface of the plate's opening, the mandrel contactingly supporting the plate so that no other apparatus is needed to brace or support the plate and so that the plate is rotated about its horizontal axis past the welding means by the mandrel, the mandrel supporting the plate so that the distance between the welding means and the part of the plate being welded is uniformly maintained, flange means disposed on the mandrel for maintaining the plate's position on the mandrel while it is rotating, drive means connected to the mandrel for rotating the mandrel, beam means connected to the mandrel for supporting the mandrel, and bearing means connected to the beam means so that the mandrel rotates in the bearing means.

6. A method for welding cladding, corrosion-resistant, or hardfacing material to a cylindrical or oval metal plate having an opening therethrough, the method comprising positioning a rotatable substantially cylindrical mandrel in proximity to welding means, the mandrel's longitudinal axis being positioned horizontally, placing the plate on the mandrel so that the plate's longitudinal axis is positioned horizontally and so that the mandrel protrudes into the plate's opening contactingly supporting the plate, the mandrel's and plate's horizontal axes being offset and noncoincident, the mandrel contacting less than the entire inner surface of the plate's opening, rotating the mandrel, thereby rotating the supported plate past the welding means and uniformly maintaining the distance between the welding means and the part of the plate being welded, and welding the material to the plate.

7. The method of claim 6, wherein the plate is disposed in proximity to flange means which are provided on the mandrel means for limiting the lateral movement of the plate on the mandrel during rotation.

* * * * *